US007954980B2

(12) United States Patent
Bryant et al.

(10) Patent No.: US 7,954,980 B2
(45) Date of Patent: Jun. 7, 2011

(54) FOLDING RECHARGEABLE WORKLIGHT

(75) Inventors: Christopher Michael Bryant, Covington, GA (US); James Richard Christ, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 105 days.

(21) Appl. No.: 12/403,575

(22) Filed: Mar. 13, 2009

(65) Prior Publication Data

US 2010/0232147 A1 Sep. 16, 2010

(51) Int. Cl.
*F21V 21/30* (2006.01)

(52) U.S. Cl. ..... 362/287; 362/184; 362/427

(58) Field of Classification Search ..... 362/183, 362/184, 249.03, 249.05, 249.09, 249.1, 362/287, 397, 398, 427
See application file for complete search history.

(56) References Cited

U.S. PATENT DOCUMENTS

| | | | | |
|---|---|---|---|---|
| 5,424,931 | A * | 6/1995 | Wheeler | 362/418 |
| D372,997 | S | 8/1996 | Meoli | |
| D382,359 | S | 8/1997 | Rorke et al. | |
| D391,656 | S | 3/1998 | Wan | |
| D392,062 | S | 3/1998 | Wan | |
| D396,891 | S | 8/1998 | Lam | |
| 6,857,756 | B2 | 2/2005 | Reiff et al. | |
| D505,217 | S | 5/2005 | Bayat et al. | |
| 6,979,100 | B2 | 12/2005 | Reiff et al. | |
| D540,484 | S | 4/2007 | Bayat et al. | |
| D546,490 | S | 7/2007 | Brown et al. | |
| D550,385 | S | 9/2007 | Hamilton et al. | |
| D556,926 | S | 12/2007 | Thirouin | |
| D558,369 | S | 12/2007 | O'Hern | |
| D567,977 | S | 4/2008 | Jianwei | |
| D567,978 | S | 4/2008 | Jianwei | |
| D588,733 | S | 3/2009 | O'Hern | |
| D593,695 | S | 6/2009 | Levine | |
| 7,556,398 | B2 * | 7/2009 | Van Der Poel | 362/184 |
| D620,627 | S | 7/2010 | Kovacik et al. | |
| 2004/0004828 | A1 * | 1/2004 | Chernick et al. | 362/184 |
| 2004/0032732 | A1 * | 2/2004 | Rubin | 362/397 |
| 2006/0034091 | A1 * | 2/2006 | Kovacik et al. | 362/398 |
| 2006/0043085 | A1 * | 3/2006 | Meyers | 219/204 |
| 2010/0110700 | A1 * | 5/2010 | Chien | 362/396 |

* cited by examiner

*Primary Examiner* — Y My Quach Lee
(74) *Attorney, Agent, or Firm* — King & Spalding LLP

(57) ABSTRACT

An LED having a center core and a first panel and a second panel coupled to the center core. The first panel includes a first array of LEDs mounted to a first circuit board disposed within a first opening formed within the first panel and a first lens disposed over the first array of LEDs. The second panel includes features similar to the first panel. The second panel is rotatable around the center core from a 0 degree closed orientation to about a 360 degree orientation, and is positionable at any intermediate angle therebetween. The LED includes a retractable hook for mounting to an elevated object. The LED also includes at least one magnet to mount the LED to vertical/vertically angling surfaces. The array of LEDs mounted to the first panel and the second panel can be controlled independently of one another.

28 Claims, 7 Drawing Sheets

FOLDING RECHARGEABLE WORKLIGHT

TECHNICAL FIELD

The present invention relates generally to electrical lighting devices, and more particularly, to a portable worklight that utilizes an array of light emitting devices, such as light emitting diodes ("LEDs").

BACKGROUND

There is often a need to enhance area rumination by using portable lighting products. One such portable lighting product is a worklight, which may be used in various settings needing light in small spaces, including, but not limited to, repair settings such as an automotive repair shop, construction settings, and other areas where no electrical outlet exists. These conventional worklights are often in a form that may be handheld or hung from a suitable elevated object.

Conventional worklights that have been in use include incandescent worklights and fluorescent worklights. Incandescent worklights provide some concerns when used in particular circumstances. Since worklights are typically used in small areas or are hung from an elevated object, the worklights may be bumped and fall. When an incandescent worklight is bumped or falls, the bulb and/or the filament can easily break, thereby making the incandescent worklight inoperable. Additionally, if the bulb breaks when being used within a flammable area, the hot filament may cause nearby flammable material to ignite and cause a fire hazard.

Although fluorescent worklights have advantages over incandescent worklights, namely, greater energy efficiency and a reduced hazard of igniting flammable materials if they fall, these fluorescent worklights suffer a similar disadvantage as incandescent worklights, for example, potentially causing a fire hazard when broken. Although there is a reduced hazard of igniting flammable materials when the worklight falls or is dropped, there is a hazard nonetheless. Fluorescent bulbs are better protected from breaking, but can still break when impacted on a hard surface. The hot electrodes within an operating fluorescent bulb may ignite nearby flammable materials when exposed during a fall.

More recently, LED worklights have been used because of certain advantages over incandescent and fluorescent worklights. LED worklights are better suitable for remaining intact after a fall. Furthermore, light source of LED worklights operate at a much lower operating temperature than the light sources of incandescent and fluorescent worklights. Thus, these lower operating temperatures are less likely to cause fires in the event of an LED worklight falling and breaking. Moreover, LED worklights provide for increased power savings when compared to incandescent and fluorescent worklights having similar luminous intensity.

One form of the conventional LED worklight is a LED stick light, where an LED array is coupled to a circuit board and mounted within a narrow hollow tube, which is at least partially transparent. The LED stick light can include a hook at one end to hang the stick light from an elevated object. These LED stick lights, however, have certain drawbacks associated with them. One drawback is that the LED stick light has a small base and is unstable during use when placed on a flat surface. Another drawback is that hook is non-retractable. The non-retractable hook can interfere with nearby objects and potentially be damaged when using and/or storing the LED stick light. A further drawback is that the LED stick light can be mounted to only one surface when using a magnet. Yet, another drawback is that the lens/transparent cover is capable of being damaged during storage or use. An additional drawback to the LED stick light is that the light output is focused only in a single small area and may be varied only by turning the entire LED stick light.

In view of the foregoing, there is a need in the art for providing a worklight having a different form factor when compared to the typical LED stick light. Also, a need is apparent for providing a worklight having a more stable base. Additionally, there exists a need for providing a worklight having a retractable hook for hanging the worklight from an elevated object. Further, there exists a need for providing a worklight mountable to at least two surfaces. Furthermore, a need exists for providing a worklight that may protect the lens from damage during use and storage. Moreover, a need exists for providing a worklight that may vary the aim of the light output so that it may provide light output in different directions, and wherein the angle between the different directions is adjustable.

SUMMARY

According to one embodiment, the worklight has a center core, a first panel coupled to the center core, and a second panel rotatably coupled to the center core. A first light source is coupled to the first panel and a second light source is coupled to the second panel. Additionally, the worklight is portable.

According to another embodiment, the worklight has a substantially cylindrical center core, a first panel coupled to the center core, and a second panel rotatably coupled to the center core. The inner core has an interior and an exterior, where the interior of the center core has a battery pack and a switch. The switch is disposed on the exterior of the center core. A first array of LED lights is disposed along a surface of the first panel and a second array of LED lights is disposed along a surface of the second panel. The second panel is rotatable to a desired orientation with respect to the first panel, such that the desired orientation ranges from a 0 degree orientation to about a 360 degree orientation.

According to a further embodiment, the portable worklight has a center core, a first panel coupled to the center core, and a second panel rotatably coupled to the center core. The first panel and the second panel are substantially C-shaped. Thus, the center core is configured as a handle when the second panel is in a closed configuration. A first array of LED lights is coupled to the first panel and a second array of LED lights is coupled to the second panel. The second panel is rotatable to a desired orientation with respect to the first panel, such that the desired orientation ranges from a 0 degree orientation to about a 360 degree orientation.

BRIEF DESCRIPTION OF THE DRAWINGS

The foregoing and other features and aspects of the invention may be best understood with reference to the following description of certain exemplary embodiments of the invention, when read in conjunction with the accompanying drawings, wherein.

Figure 1:
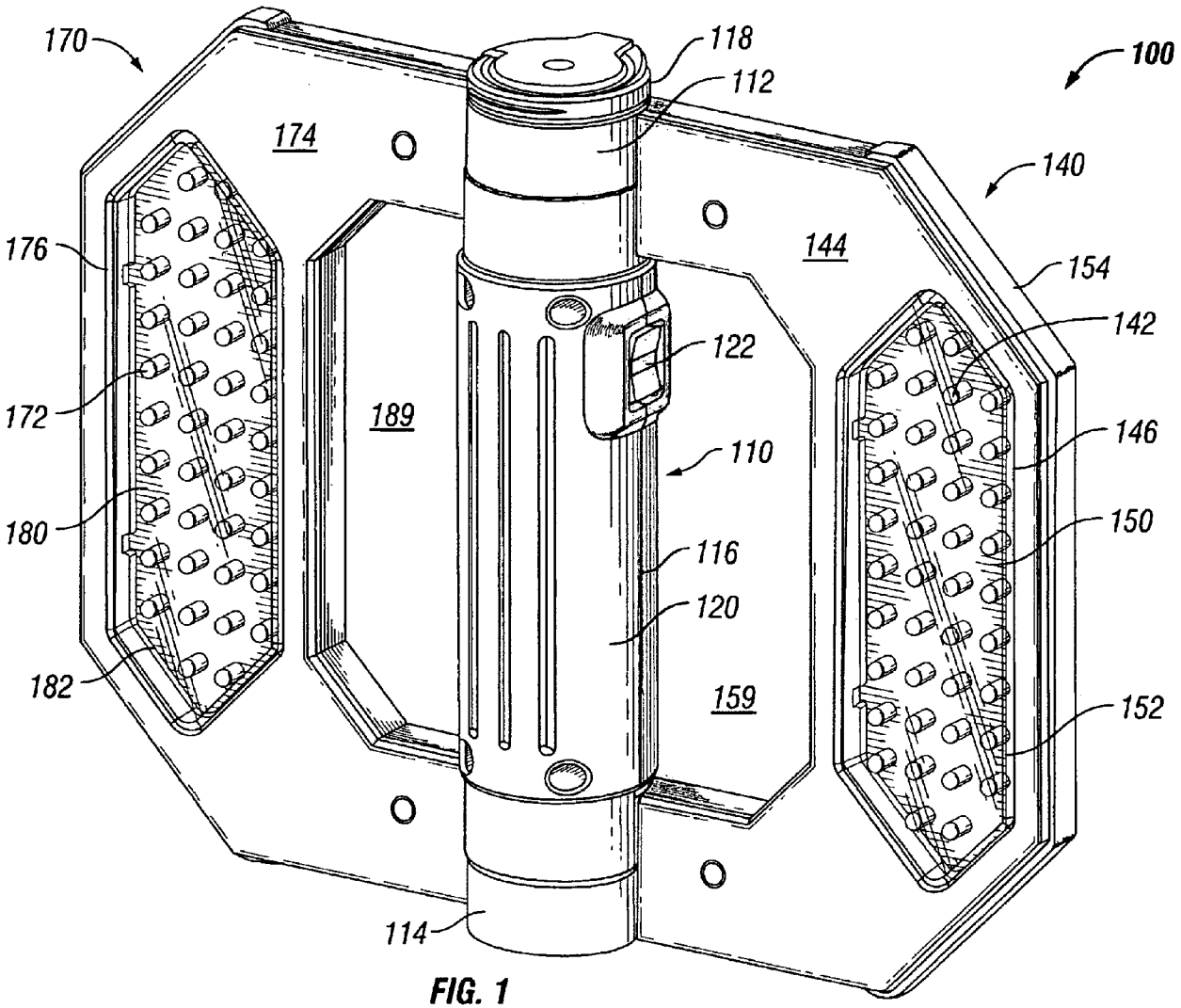
FIG. 1 shows a perspective view of an LED worklight in an open configuration in accordance with an exemplary embodiment.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to electrical lighting devices. In particular, the application is directed to a portable worklight which utilizes an array of light emitting devices, such as light emitting diodes ("LEDs"). Although the description of an exemplary embodiment of the invention is provided below in conjunction with LEDs, alternate embodiments of the invention may be applicable to other types of lamps including, but not limited to, incandescent lamps, fluorescent lamps, or a combination of lamp types known to persons of ordinary skill in the art.

The invention may be better understood by reading the following description of non-limiting, exemplary embodiments with reference to the attached drawings, wherein like parts of each of the figures are identified by the same reference characters, and which are briefly described as follows.

Figure 2:
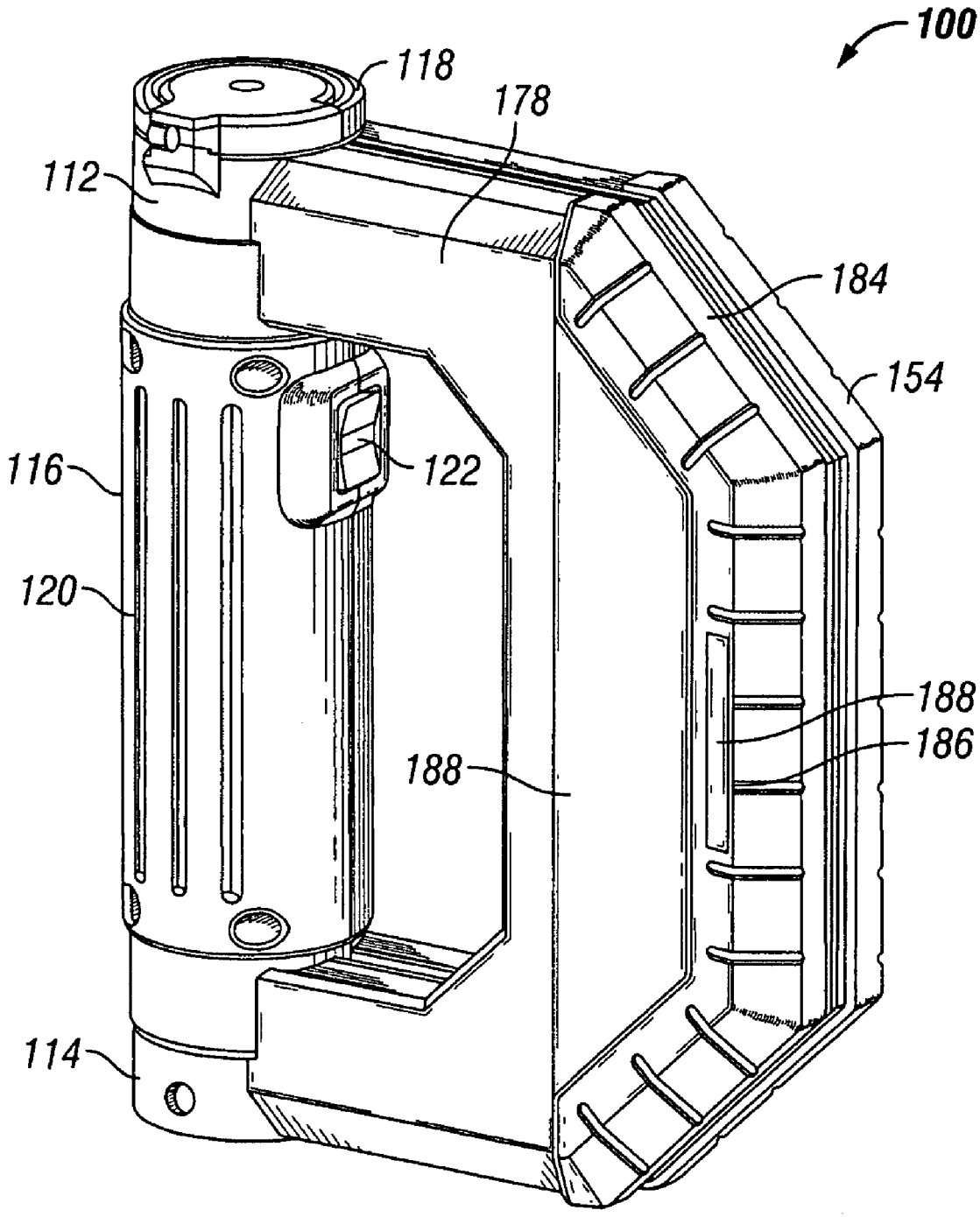
FIG. 2 shows a perspective view of the LED worklight of FIG. 1 in a closed configuration in accordance with an exemplary embodiment.

FIG. 1 shows a perspective view of an LED worklight 100 in an open configuration in accordance with an exemplary embodiment of the present invention. FIG. 2 shows a perspective view of the LED worklight 100 of FIG. 1 in a closed configuration in accordance with an exemplary embodiment of the present invention. Referring to FIGS. 1 and 2, the LED worklight 100 includes a center core 110, a first panel 140 coupled to the center core 110, and a second panel 170 rotatably coupled to the center core 110. The first panel 140 includes a first array of LEDs 142 and the second panel 170 includes a second array of LEDs 172. The LED worklight 100 may be portable. According to another exemplary embodiment, the first panel 140 and the second panel 170 are both rotatably coupled to the center core 110.

The center core 110 includes a first section 112, a second section 114, and a middle section 116 located between the first section 112 and the second section 114. In one exemplary embodiment, the center core 110 is fabricated at least partially by portions of the first panel 140 and the second panel 170, which will be further described in conjunction with FIG. 3. Additionally, the center core 110 houses several components, which also will be further discussed below in conjunction with FIG. 3. According to one exemplary embodiment, the first section 112, the second section 114, and the middle section 116 have a substantially cylindrical shape. Although the middle section 116 has been illustrated with a substantially cylindrical shape, the middle section 116 may be any geometrical shape, including triangular, rectangular, or hexagonal, without departing from the scope and spirit of the present invention. In one exemplary embodiment, the center core 110 is fabricated from any suitable material including, but not limited to, plastics, rubber, polymers, metals, and metal alloys.

The center core 110 further includes a switch 122 for controlling the first array of LEDs 142 and the second array of LEDs 172. In one exemplary embodiment, the switch 122 is positioned on the exterior of the center core 11 0 and along the middle section 116. The exemplary switch 122 is of any type of switch known to persons of ordinary skill in the art, including, but not limited to, sliding switches, rocking switches, and push button switches, without departing from the scope and spirit of the present invention. Although one switch has been illustrated, the alternative exemplary embodiments may include multiple switches, with each switch controlling one array of LEDs. Additionally, although the switch 122 has been positioned along the middle section 116 of the center core 110, the switch may be positioned anywhere on the LED worklight's 100 surface.

The center core 110 also includes a hook 118 coupled to the first section 112 or the second section 114 (not shown) for hanging the LED worklight 100 in a vertical orientation to a suitable elevated object. According to one exemplary embodiment, the hook 118 is retractable into the first section 112 to reduce potential damage and interference when not in use. According to one embodiment of the present invention, the hook 118 rotates downwardly to the first section 112 and is sized to have an outer circumference substantially equal to or less than the outer circumference of the first section 112. According to some embodiments, the hook 118 is shaped to substantially match the shape of the first section's 112 outer circumference. The hook 118 may employ alternative retracting methods including, but not limited to, a spring retraction and extraction method, which minimizes the hook 118 from extending substantially beyond the LED worklight's 100 profile. The hook 118 is fabricated from any suitable material including, but not limited to, plastics, rubbers, polymers, metals, and metal alloys. Although the hook 118 is retractable in this embodiment, alternate exemplary embodiments utilize a non-retractable hook without departing from the scope and spirit of the present invention.

Additionally, the center core 110 further includes a grip 120 coupled circumferentially around at least a portion of the middle section 116 so that an operator may easily grip the LED worklight 100. The grip 120 may have any surface including, but not limited to, smooth, ribbed, and dimpled. The grip 120 is fabricated from any suitable material including, but not limited to, plastics, rubbers, polymers, metals, and metal alloys. In one exemplary embodiment, the grip 120 is fabricated from a friction increasing polymer material.

The first panel 140 includes a first panel front side 144 having a first panel opening 146 formed therein, a first panel rear side (not shown), a first panel circuit board 150, and the first array of LEDs 142. The first array of LEDs 142 is mounted onto the first panel circuit board 150. According to one exemplary embodiment, the first array of LEDs 142 includes one or more white LEDs having a 5 millimieter ("mm") dome top and operating at about 20 milliamps. Alternate embodiments of the present invention may use different types of LEDs or different sizes of LEDs including, but not limited to, colored LEDs or a mixture of colored and white LEDs. Exemplary colors for the colored LEDs include all non-white colors including, but not limited to, red, green, and amber. Although this embodiment depicts forty LEDs in the first array of LEDs 142, the number of LEDs may be greater or fewer than forty without departing from the scope and spirit of the exemplary embodiment. Furthermore, while the first array of LEDs 142 has a substantially diamond-shaped appearance, other shapes and sizes of array are within the scope of the present invention including, but not limited to, rectangular, square, and oval. As the number of LEDs increases, the battery life decreases. Additionally, in one exemplary embodiment, the LEDs are dimmable and capable of having light output at various intensities. Moreover, each of the LEDs is typically mounted perpendicular to the first panel circuit board 150. In alternate embodiments, each of the LEDs is mounted at an angle with respect to the first panel circuit board 150 or in a combination of perpendicular and angular arrangements on the first panel circuit board 150. In one example, the angle at which the LED is mounted ranges from about 0 degrees from perpendicular to about 45 degrees on either side of perpendicular. In yet another example, the angle at which the LED is mounted ranges from about 0 degrees from perpendicular to about 90 degrees on either side of perpendicular.

The first panel circuit board 150 and the first array of LEDs 142 are releasably coupled to the first panel 140. According to this embodiment, the first panel circuit board 150 and the first array of LEDs 142 are disposed within the first panel opening 146. Some alternative embodiments, however, have the first panel circuit board 150 and the first array of LEDs 142 coupled to the surface of the first panel 140. Although the first panel opening 146 has been illustrated having a hexagonal-shaped appearance, other shapes and sizes of the first panel opening 146 are within the scope of the present invention including, but not limited to, rectangular, square, and oval.

The first panel 140 further includes a first panel lens 152 coupled to the first panel 140 along the edge of the first panel opening 146 and disposed over the first array of LEDs 142. In one exemplary embodiment, the first panel lens 152 has the same geometric shape as the first panel opening 146; however, this is not necessary. In one exemplary embodiment, the first panel lens 152 is transparent. In alternate exemplary embodiments, the first panel lens 152 is tinted any color including, but not limited to, grey, red, and amber. The first panel lens 152 is fabricated from a plastic material, a glass material, or any other translucent material. The first panel lens 152 acts as a protective cover for the first array of LEDs 142. Additionally, some embodiments utilize the first panel lens 152 to direct or diffuse the light output from the first array of LEDs 142 according to a desired pattern. In one exemplary embodiment, the first panel lens 152 is about 2 mm thick. However, the thickness of the first panel lens 152 can be more or less without departing from the scope and spirit of the present invention.

The first panel 140 also includes a first molding 154 extending around at least a portion of the outer perimeter of the first panel rear side (not shown) and over the side edge of the first panel 140. Additionally, the first panel 140 further includes at least one first panel magnet 398 (FIG. 3) coupled to the first panel rear side (not shown). Since the first panel rear side (not shown) is similar to a second panel rear side 178, the first molding 154 and the at least one first panel magnet 398 (FIG. 3) will be further described below when describing the second molding 184 and at least one second panel magnet 188.

Figure 5:
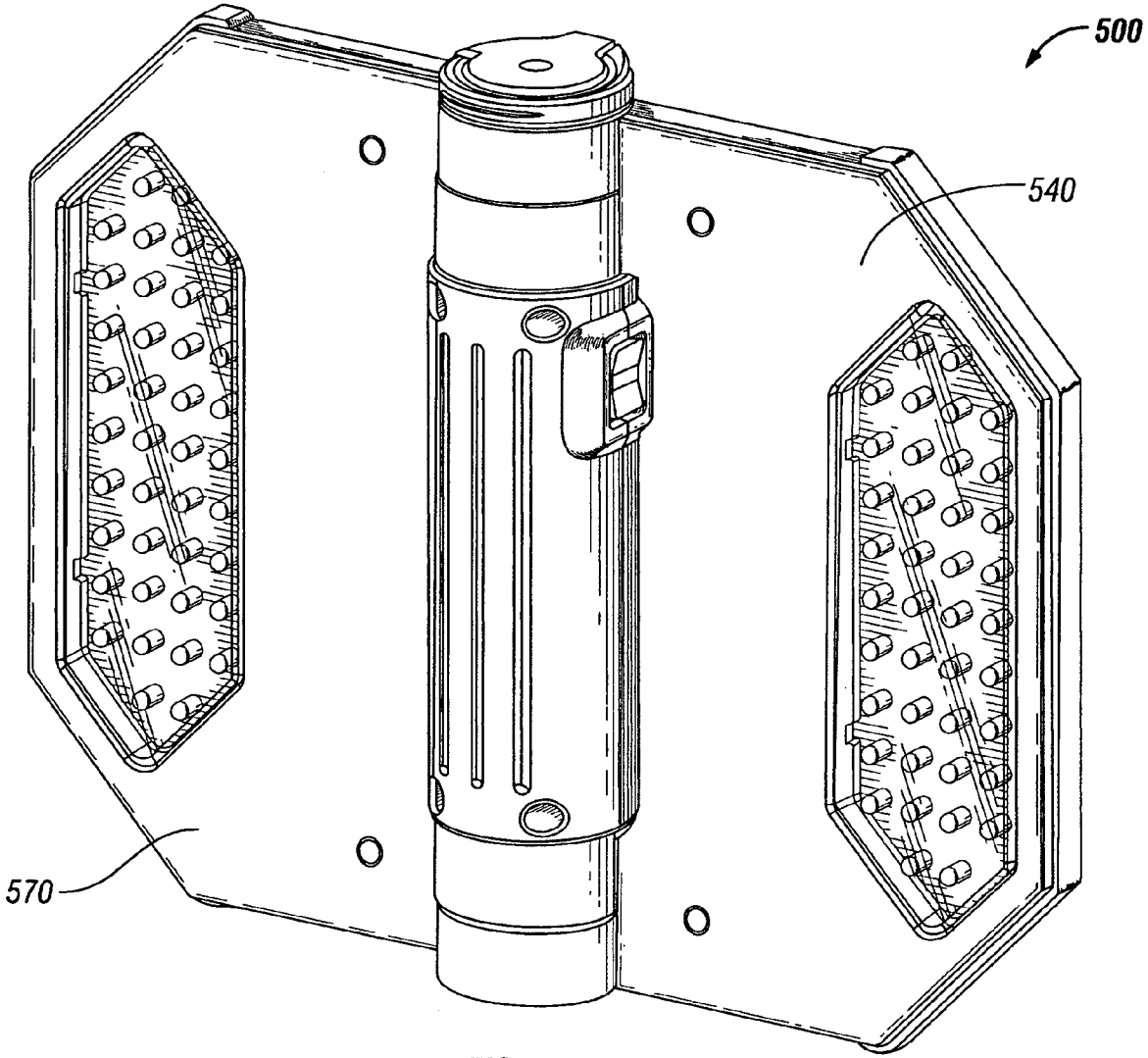
FIG. 5 shows a perspective view of an LED worklight in an open configuration in accordance with an alternative exemplary embodiment.

According to one exemplary embodiment, the first panel 140 is C-shaped, thereby forming a first air space 159 between a substantial portion of the first panel 140 and the center core 110. In this embodiment, the center core 110 functions as a handle. Although the first panel 140 has been illustrated as being C-shaped, the first panel 140 can be of any geometric shape without departing from the scope and spirit of the present invention. An example of one geometric shape that the first panel may have is illustrated in FIG. 5, which will be further described below.

Similarly, the second panel 170 includes a second panel front side 174 having a second panel opening 176 formed therein, the second panel rear side 178, a second panel circuit board 180, and the second array of LEDs 172. The second array of LEDs 172 is mounted onto the second panel circuit board 180. According to one exemplary embodiment, the second array of LEDs 172 includes one or more white LEDs having a 5 mm dome top and operating at about 20 milliamps. Alternate embodiments of the present invention may use different types of LEDs or different sizes of LEDs including, but not limited to, colored LEDs or a mixture of colored and white LEDs. Exemplary colors for the colored LEDs include all non-white colors including, but not limited to, red, green, and amber. Although this embodiment depicts forty LEDs in the second array of LEDs 172, the number of LEDs may be greater or fewer than forty without departing from the scope and spirit of the exemplary embodiment. Furthermore, while the second array of LEDs 172 has a substantially diamond-shaped appearance, other shapes and sizes of array are within the scope of the present invention including, but not limited to, rectangular, square, and oval. As the number of LEDs increases, the battery life decreases. Additionally, in one exemplary embodiment, the LEDs are dimmable and capable of having light output at various intensities. Moreover, each of the LEDs is typically mounted perpendicular to the second panel circuit board 180. In alternate embodiments, each of the LEDs is mounted at an angle with respect to the second panel circuit board 180 or in a combination of perpendicular and angular arrangements on the second panel circuit board 180. In one example, the angle at which the LED is mounted ranges from about 0 degrees from perpendicular to about 45 degrees on either side of perpendicular. In yet another example, the angle at which the LED is mounted ranges from about 0 degrees from perpendicular to about 90 degrees on either side of perpendicular.

The second panel circuit board 180 and the second array of LEDs 172 are releasably coupled to the second panel 170. According to this embodiment, the second panel circuit board 180 and the second array of LEDs 172 are disposed within the second panel opening 176. Some alternative embodiments, however, have the second panel circuit board 180 and the second array of LEDs 172 coupled to the surface of the second panel 170. Although the second panel opening 176 has been illustrated having a hexagonal-shaped appearance, other shapes and sizes of the second panel opening 176 are within the scope of the present invention including, but not limited to, rectangular, square, and oval.

The second panel 170 further includes a second panel lens 182 coupled to the second panel 170 along the edge of the second panel opening 176 and disposed over the second array of LEDs 172. In one exemplary embodiment, the second panel lens 182 has the same geometric shape as the second panel opening 176; however, this is not necessary. In one exemplary embodiment, the second panel lens 182 is transparent. In alternate exemplary embodiments, the second panel lens 182 is tinted any color including, but not limited to, grey, red, and amber. The second panel lens 182 is fabricated from a plastic material, a glass material, or any other translucent material. The second panel lens 182 acts as a protective cover for the second array of LEDs 172. Additionally, some embodiments utilize the second panel lens 182 to direct or diffuse the light output from the second array of LEDs 172 according to a desired pattern. In one exemplary embodiment, the second panel lens 182 is about 2 mm thick. However, the thickness of the second panel lens 182 can be more or less without departing from the scope and spirit of the present invention.

The second panel 170 also includes a second molding 184 extending around at least a portion of the outer perimeter of the second panel rear side 178 and over the side edge of the second panel 170. The second molding 184 is fabricated from a protective material known to persons of ordinary skill in the art including, but not limited to, rubbers, polymers, and plastics. According to some embodiments, the second molding 184 includes a second molding aperture 186. The second molding 184 and the first molding 154 provide protection to the LED worklight 100 from damage.

The second panel 170 also includes at least one second panel magnet 188 coupled to the second panel rear side 178. According to an exemplary embodiment, there are two second panel magnets 188 coupled to the second panel rear side 178, wherein one of the second panel magnets is recessedly coupled within the second molding aperture 186. This at least one second panel magnet 188 allows the second panel 170 of the LED worklight 100 to be coupled to a ferrous surface, which may be the same planar ferrous surface that the first panel 140 couples to or a ferrous surface that is adjacent to and angled with respect to the ferrous surface that the first panel 140 couples to. Although magnets have been illustrated in this embodiment, other devices may be used to couple the second panel 170 to ferrous and/or non-ferrous surfaces including, but not limited to, suction grips as shown and describe in conjunction with FIG. 6, without departing from the scope and spirit of the present invention.

According to one exemplary embodiment, the second panel 170 is C-shaped, thereby forming a second air space 189 between a substantial portion of the second panel 170 and the center core 110. In this embodiment, the center core 110 functions as a handle. Although the second panel 170 has been illustrated as being C-shaped, the second panel 170 can be of any geometric shape without departing from the scope and spirit of the present invention. An example of one geometric shape that the second panel may have is illustrated in FIG. 5, which will be further described below.

According to one exemplary embodiment, the LED worklight 100 is about 10" from the top of the first section 112 to the bottom of the second section 114 and about 12" wide when the first panel 140 and the second panel 170 are oriented 180 degrees apart in the open configuration. The first panel 140 and the second panel 170 are approximately ¾" thick. Additionally, the center core 110 has about a 2" diameter. Although exemplary dimensions have been provided for the LED worklight 100, the dimensions may vary without departing from the scope and spirit of the present invention.

Figure 3:
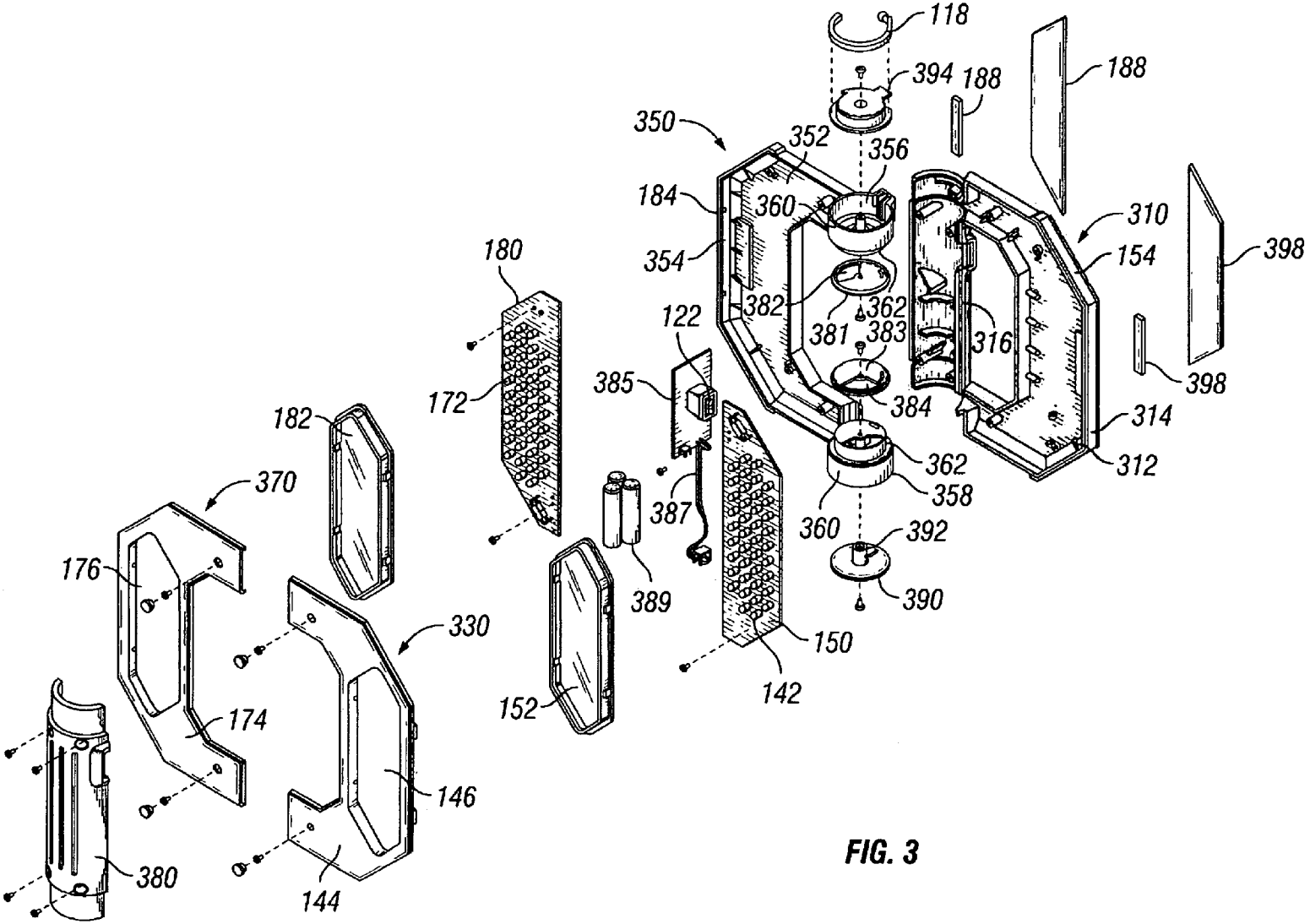
FIG. 3 shows an exploded view of the LED worklight of FIG. 1 in accordance with an exemplary embodiment.

FIG. 3 shows an exploded view of the LED worklight 100 of FIG. 1 in accordance with an exemplary embodiment. According to FIG. 3, the first panel 140 (FIG. 1) includes a first rear panel 310, the first panel circuit board 150 having the first array of LEDs 142 mounted thereon, the first panel lens 152, and a first front panel 330. The first rear panel 310 includes a first rear panel front surface 312, a first rear panel raised wall 314 surrounding the first rear panel front surface 312, the first panel rear side (not shown), and a middle portion rear panel 316 of the inner core 110 coupled to the first rear panel 310. According to this exemplary embodiment, the middle portion rear panel 316 is coupled to the first rear panel 310 at both ends of the middle portion rear panel 316 and is integrally formed with the first rear panel 310. The first rear panel 310 has a similar shape as the first panel 140 (FIG. 1), described above.

The first panel circuit board 150 is coupled to the first rear panel front surface 312 via screws. Although this exemplary embodiment shows the first panel circuit board 150 coupled to the first rear panel front surface 312 via screws, the first panel circuit board 150 can also be coupled to the first rear panel front surface 312 via alternate mounting means including, but not limited to, adhesives and snap mounts.

The first front panel 330 includes the first panel front side 144, a first panel rear side (not shown), and the first panel opening 146 formed therein and extending through the first front panel 330. According to one exemplary embodiment, the first panel lens 152 is coupled to the first panel opening 146 from the first panel rear side (not shown). The first front panel 330 is then coupled to the first rear panel 310, wherein the first panel lens 152 becomes disposed over the first panel circuit board 150 and the first array of LEDs 142. The first front panel 330 has a similar shape as the first panel 140 (FIG. 1), described above. Although the exemplary embodiment shows the first panel lens 152 coupled to the first panel opening 146 from the first panel rear side (not shown), the first panel lens 152 can be coupled to the first panel opening 146 from the first panel front side 144 via mounting means including, but not limited to, adhesives and screws, without departing from the scope and spirit of the present invention. In addition, although the exemplary embodiment shows the first front panel 330 coupled to the first rear panel 310 with screws, the first front panel 330 can also be coupled to the first rear panel 310 with alternate mounting means including, but not limited to, adhesives and snap mounting.

Similarly, according to FIG. 3, the second panel 170 includes a second rear panel 350, the second panel circuit board 180 having the second array of LEDs 172 mounted thereon, the second panel lens 182, and a second front panel 370. The second rear panel 350 includes a second rear panel front surface 352, a second rear panel raised wall 354 surrounding the second rear panel front surface 352, the second panel rear side 178 (FIG. 2), a first rotatable member 356 coupled to the top portion of the second rear panel 350, and a second rotatable member 358 coupled to the bottom portion of the second rear panel 350. According to one exemplary embodiment, the first rotatable member 356 is located at the top of the second rear panel 350 and is open at both ends, while the second rotatable member 358 is located at the bottom of the second rear panel 350 and also is open at both ends. Each of the first rotatable member 356 and the second rotatable member 358 has a large section 360 and a small section 362, where the small section 362 is adjacent the large section 360 and has a smaller circumference than the large section 360. The small section 362 is located entirely within the circumference of the large section 360. According to this exemplary embodiment, the first rotatable member 356 and the second rotatable member 358 are both integrally formed with the second rear panel 350 and form a portion of the first section 112 of the inner core 110 and a portion of the second section 114 of the inner core 110, respectively. Alternatively, the first rotatable member 356 and the second rotatable member 358 may both be integrally formed as part of the first rear panel 310. Alternatively, one of the first rotatable member 356 and the second rotatable member 358 may be integrally formed as part of the second rear panel 350, while the other one is integrally formed as part of the first rear panel 310.

The second panel circuit board 180 is coupled to the second rear panel front surface 352 via screws. Alternatively, the second panel circuit board 180 is coupled to the second rear panel front surface 352 via alternate mounting means including, but not limited to, adhesives and snap mounts.

The second front panel 370 includes the second panel front side 174, a second panel rear side (not shown), and the second panel opening 176 formed therein and extending through the second front panel 370. According to this exemplary embodiment, the second panel lens 182 is coupled to the second panel opening 176 from the second panel rear side (not shown). The second front panel 370 is then coupled to the second rear panel 350, wherein the second panel lens 182 becomes disposed over the second panel circuit board 180 and the second array of LEDs 172. The second front panel 370 has a similar shape as the second panel 170 (FIG. 1), described above. Although this exemplary embodiment shows the second panel lens 182 coupled to the second panel opening 176 from the second panel rear side (not shown), the second panel lens 182 can be coupled to the second panel opening 176 from the second panel front side 174 via mounting means including, but not limited to, adhesives and screws, without departing from the scope and spirit of the present invention. Alternatively, the second front panel 370 is coupled to the second rear panel 350 via alternate mounting means including, but not limited to, adhesives and snap mounting.

The second panel 170 is coupled to the first panel 140 in a manner where the small sections 362 of the first rotatable member 356 and the second rotatable member 358 are positioned within the ends of the middle portion rear panel 316 and the large sections 360 of the first rotatable member 356 and the second rotatable member 358 are positioned exteriorly at the ends of the middle portion rear panel 316.

A first friction ring 381 including a first passageway 382 is coupled to the small section 362 of the first rotatable member 356. The first friction ring 381 has a shape similar to that of the small section 362. In one exemplary embodiment, the first passageway 382 provides a pathway for wires and/or other equipment to pass through. Although this exemplary embodiment shows the first friction ring 381 coupled to the small section 382 via a screw, alternate coupling means, as previously described, can be utilized without departing from the scope and spirit of the present invention. Similarly, a second friction ring 383 having a second passageway 384 is coupled to the small section 362 of the second rotatable member 358. The second friction ring 383 also has a shape similar to that of the small section 362. The second passageway 384 provides a pathway for wires and/or other equipment to pass through. Although this exemplary embodiment shows the second friction ring 383 coupled to the small section 382 via a screw, alternate coupling means, as previously described, can be utilized.

A recharge and switch mounting board 385 and a battery pack 389 are coupled to the interior side of the middle portion rear panel 316. The recharge and switch mounting board 385 includes the switch 122 that extends to the exterior side of the center core 110 (FIG. 1). The battery pack 389 is electrically coupled to the recharge and switch mounting board 385 via a connecting wire 387. In alternative exemplary embodiments, the battery pack 389 includes a rechargeable battery pack or a non-rechargeable battery pack.

A middle portion front panel 380, which is approximately the same length as the middle portion rear panel 316, is coupled to the middle portion rear panel 316 so that the small sections 362 are enclosed between the middle portion front panel 380 and the middle portion rear panel 316. According to FIG. 3, the middle portion front panel 380 is coupled to the middle portion rear panel 316 via screws. However, alternate embodiments may utilize other coupling means known to those of ordinary skill in the art, including some of which have been mentioned above.

A base cap 390 is screw mounted to the opening of the large section 360 of the second rotatable member 358. The base cap 390 includes a direct current ("DC") jack 392 located on the surface of the base cap 390. The DC jack 392 is coupled to the battery pack 389 and recharges the battery pack 389. Although the exemplary embodiment shows the DC jack 392 located on the surface of the base cap 390, the DC jack 392 can be located in alternate locations including, but not limited to, the first panel 140, the second panel 170, and other locations within the center core 110, without departing from the scope and spirit of the exemplary embodiment. Although the exemplary embodiment shows the base cap 390 being screw mounted to the opening of the large section 360 of the second rotatable member 358; alternatively, the base cap 390 can be mounted via other known means including, but not limited to, thread mount, clip mount, and pin mount, without departing from the scope and spirit of the exemplary embodiment.

A top cap 394 is screw mounted to the opening of the large section 360 of the first rotatable member 356. In addition, the top cap 394 is coupled to the hook 118, which may be retractable. Although the exemplary embodiment shows the top cap 394 being screw mounted to the opening of the large section 360 of the first rotatable member 356; alternatively, the top cap 394 can be mounted via other known means including, but not limited to, thread mount, clip mount, and pin mount, without departing from the scope and spirit of the exemplary embodiment.

As previously mentioned, the first molding 154 is coupled to at least a portion of the outer perimeter of the first panel rear side (not shown) and over the side edge of the first panel rear side (not shown). The first panel magnet 398 also is coupled to the first panel rear side (not shown) to allow for mounting the LED worklight 100 (FIG. 1) to a ferrous surface. Similarly, the second molding 184 is coupled to at least a portion of the outer perimeter of the second panel rear side 178 (FIG. 2) and over the side edge of the second panel rear side 178 (FIG. 2). The second panel magnet 188 also is coupled to the second panel rear side 178 (FIG. 2) to allow for mounting the LED worklight 100 (FIG. 1) to a ferrous surface. As a result, the LED worklight 100 (FIG. 1) is mountable to two non-planar ferrous surfaces simultaneously.

Figure 4:
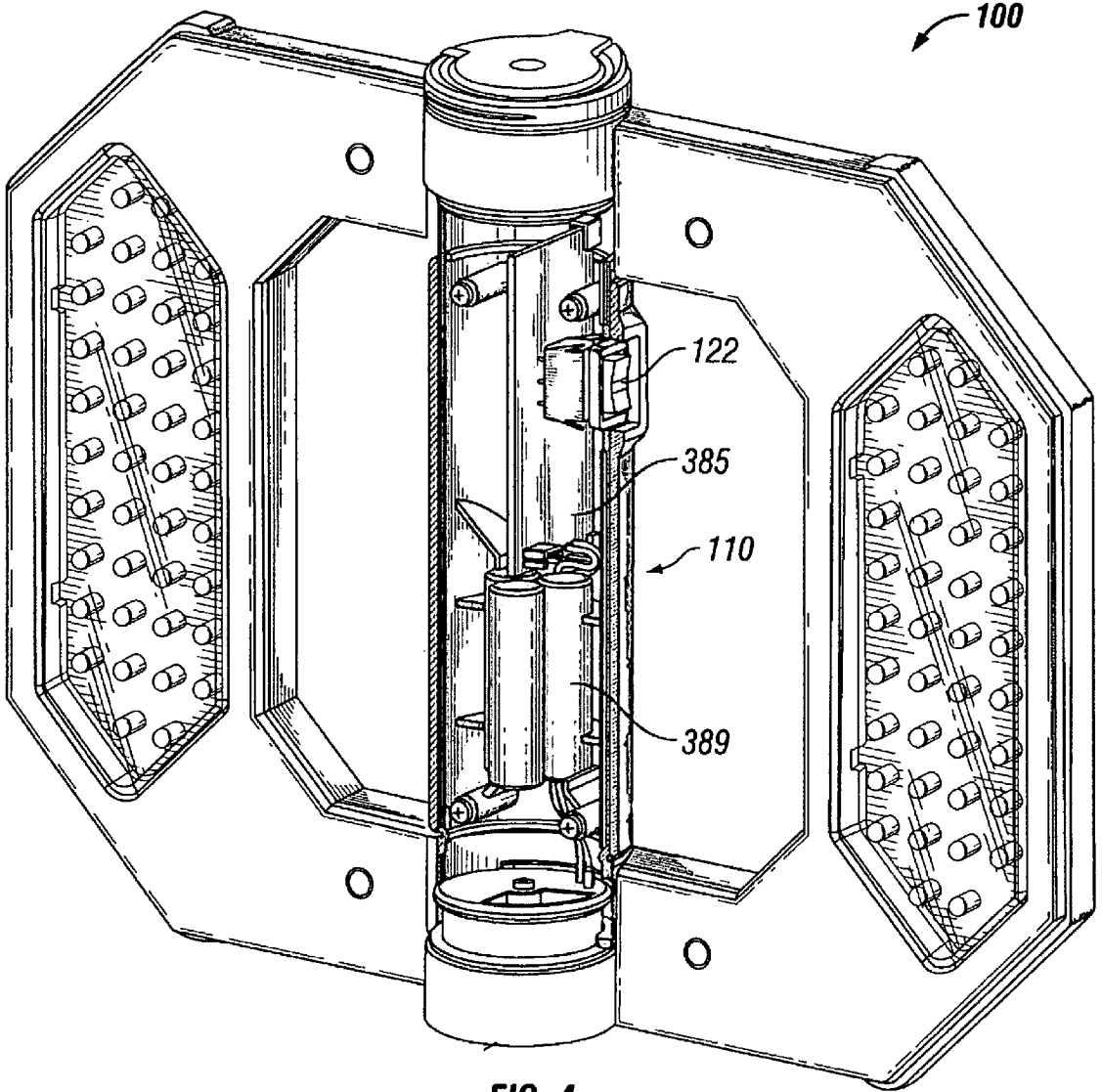
FIG. 4 shows a perspective view of the LED worklight of FIG. 1 having a middle portion front panel removed in accordance with an exemplary embodiment.

FIG. 4 shows a perspective view of the LED worklight 100 of FIG. 1 having a middle portion front panel 380 (FIG. 3) removed in accordance with an exemplary embodiment. The battery pack 389 is located at the bottom portion of the center core 110, while the recharge and switch mounting board 385 is located at the top portion of the center core 110. The battery pack 389, the DC jack 392 (FIG. 3), and the recharge and switch mounting board 385 are all electrically coupled to one another. Additionally, the switch 122 is coupled to the recharge and switch mounting board 385 in a manner where the switch 122 extends to the exterior side of the center core 110. Although this exemplary embodiment shows specific locations for positioning the battery pack 389 and the recharge and switch mounting board 385, these locations vary within the center core 110 without departing from the scope and spirit of the exemplary embodiment.

FIGS. 1-4 collectively illustrate one embodiment of the LED worklight 100. The second panel 170 of the LED worklight 100 is independently rotatable with respect to the first panel 140. The second panel 170 is rotatable to a desired orientation with respect to the first panel 140, such that the desired orientation ranges from a 0 degree orientation, which is a closed configuration, to about a 210 degree orientation. The second panel 170 is positionable at any angle between the 0 degree orientation and the approximately 210 degree orientation. Thus, the light output from the first array of LEDs 142 and the light output from the second array of LEDs 172 is independently directed or aimed to a desired area. Although this exemplary embodiment shows the desired orientation ranging from a 0 degree orientation to about a 210 degree orientation, the desired orientation can range from a 0 degree orientation to about a 360 degree orientation without departing from the scope and spirit of the exemplary embodiment. Thus, in alternative exemplary embodiments, the second panel 170 can be positionable at any angle between the 0 degree orientation and the approximately 360 degree orientation.

Further, when the LED worklight 100 is positioned on a horizontal surface with the first panel 140 and the second panel 170 facing horizontally, the LED worklight 100 illuminates desired work areas including, but not limited to, walls or other generally vertical work surfaces. The first panel 140, the second panel 170, and the center core 110 provide stability to the LED worklight 100 by providing a substantially triangulated mount. Additionally, the LED worklight 100 is positionable horizontally, on a horizontal surface, such that the first panel 140 and the second panel 170 face vertically. In this position, the LED worklight 100 illuminates desired work areas including, but not limited to, ceilings or other generally horizontal work surfaces; for example, the underside of a vehicle. The large flat surfaces of the LED worklight 100 resist changing light output direction due to the inadvertent movement of the LED worklight 100 via the first friction ring 381 and the second friction ring 383. Whether the LED worklight 100 is placed vertically on a horizontal surface or horizontally on a horizontal surface, the second panel 170 is positionable at any angle with respect to the first panel 140.

Figure 6:
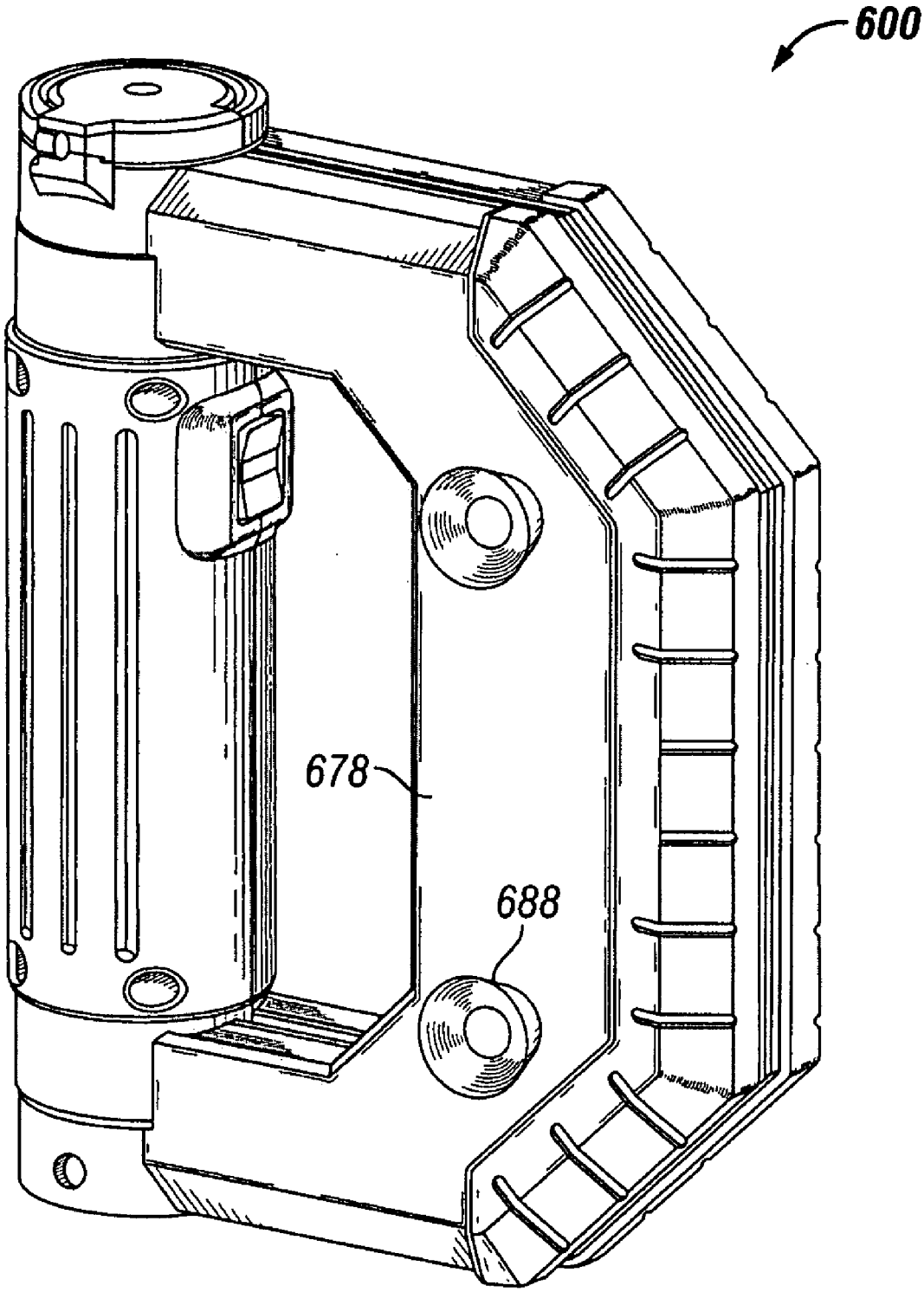
FIG. 6 shows a perspective view of an LED worklight having one or more suction grips in accordance with another exemplary embodiment.

In addition to being capable of mounting to a horizontal surface, the LED worklight 100 is mountable to a vertical surface or to a vertically angling surface. The first panel magnet 398 and the second panel magnet 188 can be magnetically coupled to a vertical or vertically angling surface. In one exemplary embodiment, the LED worklight 100 is mounted to two non-planar surfaces adjacent to one another, where the first panel 140 is mounted to a first surface and the second panel 170 is mounted to a second surface that is non-planar to the first surface. Thus, the LED worklight 100 is mountable to a single surface or to two non-planar surfaces. This mounting feature is particularly useful when working in confined spaces with irregular surfaces, such as the engine bay of an automobile. The use of multiple magnets also allows the LED worklight 100 to be oriented as desired. According to this exemplary embodiment, the vertical or vertically angling surface are fabricated from ferrous material so that the first panel magnet 398 and the second panel magnet 188 couple to it. However, in alternate embodiments, other coupling devices including, but not limited to, suction grips as shown and described in conjunction with FIG. 6, are used so that the LED worklight 100 mounts to non-ferrous vertical and vertically angling surfaces.

Further, the hook 118 provides a mechanism for hanging the LED worklight 100 to a suitable elevated object. According to one exemplary embodiment, hanging the LED worklight 100 by the hook 118 positions the LED worklight 100 in a vertical orientation. In one exemplary embodiment, the hook 118 is retractable, so that the hook 118 retracts into the top cap 394 to reduce potential damage and interference when not in use.

The LED worklight 100 is stored in a manner to protect the first panel lens 152 and the second panel lens 182 from damage. Since the second panel 170 is rotatable, the LED worklight 100 is stored with the second panel 170 positioned in the 0 degree orientation, or closed configuration, in which the first panel lens 152 faces the second panel lens 182. The ability to protect the panel lenses when not in use lengthens the useful life of the LED worklight 100 and provides more freedom for the user when selecting storage locations. Additionally, the LED worklight 100 reduces in width by about 40 percent when the second panel 170 is in the closed orientation, i.e. 0 degree orientation. This reduction in width also provides more freedom to the user when selecting a storage location.

Moreover, the LED worklight 100 provides versatility when operating the first array of LEDs 142 and the second array of LEDs 172, which also extends the battery pack's 389 life. The LED worklight 100 operates alternatively with both the first array of LEDs 142 and the second array of LEDs 172 fully on, the first array of LEDs 142 and the second array of LEDs 172 off, the first array of LEDs 142 on and the second array of LEDs 172 off, the first array of LEDs 142 off and the second array of LEDs 172 on, or either or both of the first array of LEDs 142 and the second array of LEDs 172 being dimmable. This adjustability provides the appropriate amount of light output that is necessary, thereby prolonging the battery pack's 389 life.

FIG. 5 shows a perspective view of an LED worklight 500 in an open configuration in accordance with an alternative exemplary embodiment. In this exemplary embodiment, the LED worklight 500 includes a first panel 540 and a second panel 570. As shown, the first panel 540 and the second panel 570 have a geometric shape that is substantially a filled-in D-shape. Thus, the first air space 159 (FIG. 1) and the second air space 189 (FIG. 1) of LED worklight 100 (Figure) are no longer similarly present in this exemplary embodiment. According to some exemplary embodiments, one of the first panel and the second panel may have an air space similar to the first air space 159 (FIG. 1), while the other panel has no air space.

FIG. 6 shows a perspective view of an LED worklight 600 having one or more suction grips 688 in accordance with another exemplary embodiment. LED worklight 600 includes a first panel rear side (not shown) and a second panel rear side 678. The first panel rear side (not shown) and the second panel rear side 678 include one or more suction grips 688 for mounting the LED worklight 600 to ferrous and/or non-ferrous vertical and vertically angling surfaces. Although two suction grips 688 have been illustrated on the second panel rear side 678, more or less suction grips 688 can be used depending upon the weight of the LED worklight 600.

Figure 7:
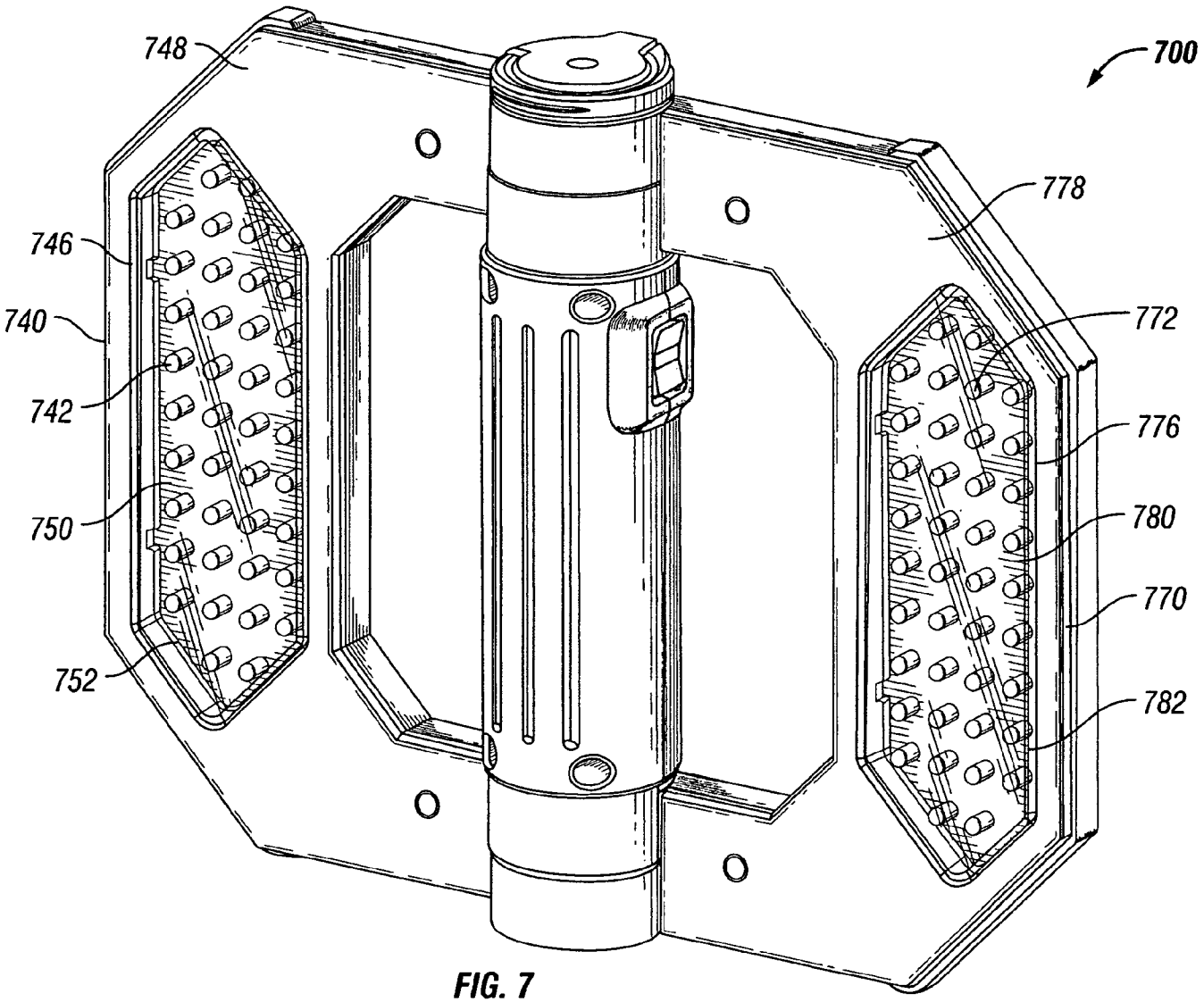
FIG. 7 shows a perspective view of the rear side of an LED worklight in an open configuration in accordance with an alternative exemplary embodiment.

FIG. 7 shows a perspective view of the rear side of an LED worklight 700 in an open configuration in accordance with an alternative exemplary embodiment. The LED worklight 700 includes a first panel 740 having a first panel front side (not shown) and a first panel rear side 748 and a second panel 770 having a second panel front side (not shown) and a second panel rear side 778. In this exemplary embodiment, the first panel rear side 748 is substantially similar to the first panel front side (not shown), which is substantially similar to the first panel front side 144 (FIG. 1) of LED worklight 100 (FIG. 1). The first panel rear side 748 further includes a third panel opening 746 formed therein, a third panel circuit board 750, a third array of LEDs 742, and a third panel lens 752. The third array of LEDs 742 is mounted onto the third panel circuit board 750. The third panel circuit board 750 and the third array of LEDs 742 is coupled to the first panel 740 in a similar manner as the first panel circuit board 150 (FIG. 1) and the first array of LEDs 142 (FIG. 1) couple to the first panel 140 (FIG. 1). The third panel lens 752 is coupled to the third panel opening 746 and disposed over the third array of LEDs 742. According to certain exemplary embodiments, the third panel lens 752 is transparent, while in alternate embodiments, the third panel lens 752 is tinted any color including, but not limited to, grey, red, and amber. Also, according to certain exemplary embodiments, the third array of LEDs 742 includes one or more white LEDs having a 5 mm dome top and operating at 20 milliamps. Alternative embodiments of the present invention use different types of LEDs or different size LEDs including, but not limited to, colored LEDs. Exemplary colors for the colored LEDs include all non-white colors including, but not limited to, red, green, and amber. The third array of LEDs 742 emits constant, flashing, or dimmable light and is capable of emitting light at various intensities.

Similarly, the second panel rear side 778 is substantially similar to the second panel front side (not shown), which is substantially similar to the second panel front side 174 (FIG. 1) of LED worklight 100 (FIG. 1). The second panel rear side 778 further includes a fourth panel opening 776 formed therein, a fourth panel circuit board 780, a fourth array of LEDs 772, and a fourth panel lens 782. The fourth array of LEDs 772 is mounted onto the fourth panel circuit board 780. The fourth panel circuit board 780 and the fourth array of LEDs 772 are coupled to the second panel 770 in a similar manner as the second panel circuit board 180 (FIG. 1) and the second array of LEDs 172 (FIG. 1) couple to the second panel 170 (FIG. 1). The fourth panel lens 782 is coupled to the fourth panel opening 776 and disposed over the fourth array of LEDs 772. According to certain exemplary embodiments, the fourth panel lens 782 is transparent, while in alternate embodiments, the fourth panel lens 782 is tinted any color including, but not limited to, grey, red, and amber. Also, according to certain exemplary embodiments, the fourth array of LEDs 772 includes one or more white LEDs having a 5 mm dome top and operating at 20 milliamps. Alternative embodiments of the present invention use different types of LEDs or different size LEDs including, but not limited to, colored LEDs. Exemplary colors for the colored LEDs include all non-white colors including, but not limited to, red, green, and amber. The fourth array of LEDs 772 emits constant, flashing, or dimmable light and is capable of emitting light at various intensities.

The third array of LEDs 742 and the fourth array of LEDs 772 are controlled in a manner substantially similar to the first array of LEDs 142 (FIG. 1) and the second array of LEDs 172 (FIG. 1) in that the third array of LEDs 742 and the fourth array of LEDs 772 can both emit light simultaneously, both be turned off, or only one of them emits light at a time. Additionally, as previously mentioned, the third array of LEDs 742 and the fourth array of LEDs 772 emit constant, flashing, or dimmable light.

In yet another alternative embodiment, the first panel rear side (not shown) and the second panel rear side 178 also include one or more reflective devices, or reflective coatings, coupled, or applied, thereon. One example of a reflective device includes a reflective polymer tape that adheres to the first panel rear side (not shown) and the second panel rear side 178.

The reflective device and the third array of LEDs and fourth array of LEDs provide a safety feature for the LED worklight 100 when used in low lighting environments, such as roadside repairs on a vehicle during the night.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the invention. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. An apparatus, comprising:

a center core comprising and extending along a longitudinal axis;

a first panel coupled to the center core and comprising a first surface disposed in a first plane parallel to the longitudinal axis;

a first light source positioned along the first surface of the first panel;

a second panel comprising a second surface disposed in a second plane parallel to the longitudinal axis and rotatably coupled to rotate about the longitudinal axis of the center core; and a second light source positioned along the second surface of the second panel.

2. The apparatus of claim 1, wherein the first light source comprises a first array of LEDs and the second light source comprises a second array of LEDs.

3. The apparatus of claim 1, wherein the first light source is coupled to the first surface of the first panel and the second light source is coupled to the second surface of the second panel.

4. The apparatus of claim 3, further comprising at least one magnet coupled to a third surface of the first panel and at least one other magnet coupled to a fourth surface of the second panel, wherein the third surface is disposed in a third plane parallel to the longitudinal axis, and wherein the fourth surface is disposed in a fourth plane parallel to the longitudinal axis.

5. The apparatus of claim 3, further comprising at least one suction grip coupled to a third surface of the first panel and at least one other suction grip coupled to a fourth surface of the second panel, wherein the third surface is disposed in a third plane parallel to the longitudinal axis, and wherein the fourth surface is disposed in a fourth plane parallel to the longitudinal axis.

6. The apparatus of claim 3, further comprising at least one reflective device coupled to one or more of a third surface of the first panel and a fourth surface of the second panel, wherein the third surface is disposed in a third plane parallel to the longitudinal axis, and wherein the fourth surface is disposed in a fourth plane parallel to the longitudinal axis.

7. The apparatus of claim 3, further comprising a third light source coupled to a third surface of the first panel, wherein the third surface is disposed in a third plane parallel to the longitudinal axis.

8. The apparatus of claim 7, wherein the third light source comprises a third array of LEDs.

9. The apparatus of claim 7, further comprising a fourth light source coupled to a fourth surface of the second panel, wherein the fourth surface is disposed in a fourth plane parallel to the longitudinal axis.

10. The apparatus of claim 9, wherein the fourth light source comprises a fourth array of LEDs.

11. The apparatus of claim 9, wherein the third light source and the fourth light source emit a non-white light.

12. The apparatus of claim 9, wherein the third light source and the fourth light source are each operable in an intermittent on/off state to generate a blinking light.

13. The apparatus of claim 1, wherein at least a portion of the first light source and the second light source emit a non-white light.

14. The apparatus of claim 1, further comprising a first panel lens disposed over the first light source and a second panel lens disposed over the second light source.

15. The apparatus of claim 14, wherein the first panel lens and the second panel lens are transparent.

16. The apparatus of claim 14, wherein the first panel lens and the second panel lens each comprise a colored tint.

17. The apparatus of claim 1, wherein the first light source and the second light source are each operable in an intermittent on/off state to generate a blinking light.

18. The apparatus of claim 1, wherein the first light source and the second light source are dimmable.

19. The apparatus of claim 1, wherein the second panel is rotatable to a desired orientation with respect to the first panel, the desired orientation ranging from beyond 90 degrees and less than 270 degrees.

20. The apparatus of claim 1, wherein the center core comprises a recharge and switch mounting board, a battery pack electrically coupled to the recharge and switch mounting board, and a switch, the switch extending from the exterior of the center core.

21. The apparatus of claim 1, further comprising a hook coupled to one end of the center core.

22. The apparatus of claim 1, wherein the first light source is operable independent of the second light source.

23. The apparatus of claim 1, wherein the first panel and the second panel are C-shaped and the center core is configured as a handle.

24. The apparatus of claim 23, wherein the handle is positioned between the first panel and the second panel when the second panel is oriented 180 degrees from the first panel.

25. The apparatus of claim 1, wherein the second panel is rotatable independent of the first panel.

26. An apparatus, comprising:

a center core comprising a first end and a distal second end and extending between the first and second ends along a longitudinal axis;

a first panel coupled to the center core at a first point adjacent to the first end and a second point adjacent to the second end;

a first light source coupled to the first panel;

a second panel rotatably coupled to the center core at a third point adjacent the first end and a fourth point adjacent the second end to rotate about the longitudinal axis; and a second light source coupled to the second panel.

27. An apparatus, comprising:

a center core;

a first panel coupled to the center core and comprising a first surface;

a first array of LED lights coupled to the first panel;

a second panel comprising a second surface and rotatably coupled to the center core; and a second array of LED lights coupled to the second panel, wherein the second panel is rotatable to a desired orientation with respect to the first panel, the desired orientation ranging from a 0 degree orientation to about a 360 degree orientation, wherein when the desired orientation is a 180 degree orientation, the first surface and the second surface are both positioned in a first plane and facing the same direction, and wherein when the desired orientation is a 0 degree orientation, the first surface and the second surface are facing opposite directions and the first panel abuts the second panel.

28. The apparatus of claim 27, wherein the first panel is rotatably coupled to the center core.

* * * * *